United States Patent [19]

Mitadera et al.

[11] Patent Number: 4,688,529

[45] Date of Patent: Aug. 25, 1987

[54] LUBRICATING SYSTEM FOR HORIZONTAL CYLINDER OVERHEAD VALVE ENGINE

[75] Inventors: Takashi Mitadera, Akashi; Tetsuaki Shirai, Kobe; Tomozo Nakagawa; Naotake Nii, both of Akashi; Kozo Watanabe, Ono, all of Japan

[73] Assignee: Kawasaki Jukogyo Kabushiki Kaisha, Kobe, Japan

[21] Appl. No.: 883,718

[22] Filed: Jul. 9, 1986

[30] Foreign Application Priority Data

Jul. 10, 1985 [JP] Japan ..... 60-152812
Feb. 20, 1986 [JP] Japan ..... 61-36033

[51] Int. Cl.[4] ..... F01M 1/00

[52] U.S. Cl. ..... 123/196 R; 123/195 HC; 184/6.5; 184/6.9

[58] Field of Search ..... 123/196 R, 195 HC, 90.33; 184/6.6, 6.9, 6.5

[56] References Cited

U.S. PATENT DOCUMENTS 4,570,587 2/1986 Watanabe et al. ..... 123/195 C

FOREIGN PATENT DOCUMENTS 60-6585 3/1985 Japan .

*Primary Examiner*—E. Rollins Cross
*Attorney, Agent, or Firm*—Leydig, Voit & Mayer

[57] ABSTRACT

A lubricating system for an internal combustion engine is disclosed. This system includes a pair of passages formed between a crank chamber for reserving oil and an air-oil separating chamber accommodating a mechanism for actuating overhead valves. The pair of passages are constituted by a breather passage formed in the upper portion of a cylinder and the oil-returning passage formed in the lower portion of the cylinder. The breather passage has a valve for allowing a fluid to pass solely toward the air-oil separating chamber and a large oil-circulating resistance is imparted to the fluid flowing toward the air-oil separating chamber through the oil-returning passage, thereby circulating an oil mist in one direction only by using the reciprocal motion of each piston. Even when the engine is inclined, oil is prevented from flowing back from the crank chamber to the separating chamber through the oil-returning passage.

4 Claims, 9 Drawing Figures

LUBRICATING SYSTEM FOR HORIZONTAL CYLINDER OVERHEAD VALVE ENGINE

BACKGROUND OF THE INVENTION

1. FIELD OF THE INVENTION

The present invention generally relates to an internal combustion engine in which the cylinder or cylinders is disposed substantially horizontally, the cylinder having intake and exhaust valves at its head. More specifically, this invention pertains to a lubricating system incorporated in the foregoing internal combustion engine which is equipped with a breather passage and an oil-returning passage providing communication between a crank chamber for storing a lubricating oil and an air-oil separating chamber located on the side of the cylinder head, without any special lubricating pump being included for lubricating a valve drive mechanism.

2. DESCRIPTION OF THE PRIOR ART

The above-mentioned lubricating system is arranged in the following manner. The oil mist produced within the crank chamber is subjected to the positive pressure which is generated by the reciprocal motion of the piston within the crank chamber, and the oil mist is fed to the air-oil separating chamber through the breather passage. After the mist has lubricated a valve operating mechanism within the air-oil separating chamber, the oil component is accumulated therein. The thus-accumulated oil is subjected to the force of gravity and the negative pressure produced within the crank chamber and is caused to flow into the crank chamber through the oil-returning passage. Since such a system has a very simple structure, it has been used in various small-sized overhead valve engines, and Japanese Utility Model Examined Publication No. 6585/1985 discloses such a lubricating system.

The above-described prior-art system can be adapted to a vertical cylinder engine without difficulty. However, if the prior art is to be applied to an engine having a substantially horizontal cylinder, when the pressure within the crank chamber changes from negative to positive, the positive pressure acts not only on the breather passage but also the oil-returning passage. As a result, there is a risk of the oil being forced back to the air-oil separating chamber while flowing in the oil-returning passage.

In addition, the prior-art system involves difficulties in that a large quantity of lubricating oil is prone to flow back from the crank chamber to the air-oil separating chamber through the oil-returning passage when an operator inclines the cylinder head downwardly when wishing to inspect the engine or other working parts coupled thereto when the engine is inoperative. After this large quantity of oil has entered the air-oil separating chamber, it in turn flows through a breather port into an air cleaner, a carburetor, a combustion chamber and a muffler, thereby raising such problems as difficulty in starting, damage to or contamination of air cleaner elements, and the generation of white smoke.

One type of internal combustion engine is known in which a breather is extended directly out of the engine through its breather port. Should the cylinder head of the engine be inclined downwardly, a large quantity of lubricating oil within the air-oil separating chamber is discharged out of the engine, thereby causing such problem as damage to or contamination of the engine.

SUMMARY OF THE INVENTION

Accordingly, an object of the present invention is to provide a lubricating system for a horizontal cylinder overhead valve engine which is arranged such that, while the lubricating oil is returning to the crank chamber, the oil is not forced back toward the air-oil separating chamber even if the pressure within the crank chamber rises.

Another object of the present invention is to provide a lubricating system for a horizontal cylinder overhead valve engine which is arranged such that the lubricating oil does not flow back from the crank chamber to the air-oil separating chamber even when the cylinder head is inclined downwardly when the engine or other working parts coupled thereto are being inspected while the engine is inoperative, thereby solving the above-described problems.

To these ends, the present invention provides a lubricating system comprising means disposed in the breather passage in such a manner as to allow a fluid to flow solely toward the air-oil separating chamber and means disposed in the oil returning passage in such a manner as to impart to the fluid flow toward the air-oil separating chamber a resistance higher than that of the fluid flow toward the air-oil separating chamber through the breather passage.

These and other objects of the invention will become more apparent in the detailed description and examples which follow.

DETAILED DESCRIPTION OF THE PREFERRED EMBODIMENT

Figure 2:
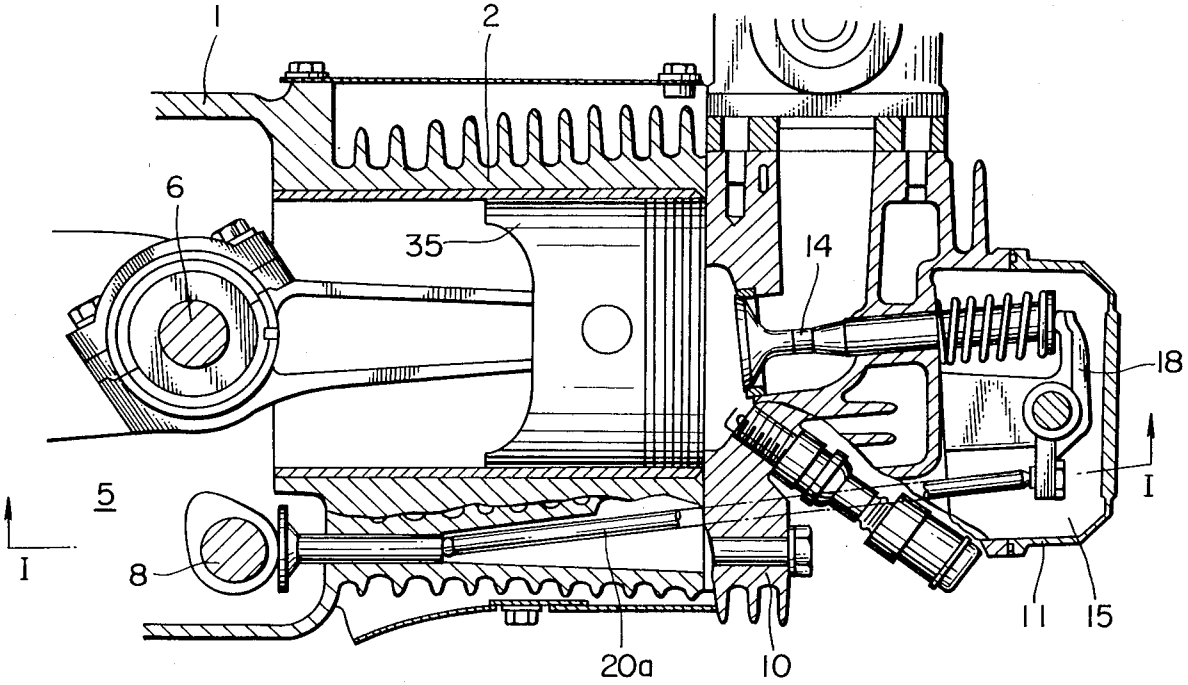
FIG. 2 is a horizontal section, partially broken away, taken along the line II—II of FIG. 1.

Referring to FIG. 2 showing a horizontal section, partially broken away, of an engine incorporating a preferred embodiment of the lubricating system of this invention, a crank case 1 is integral with a cylinder 2, and a crank shaft 6 and a cam shaft 8 for driving inlet and exhaust valves are rotatably supported by a crank chamber 5.

The cylinder 2 is disposed in the form of a horizontal cylinder in which the axis thereof is horizontally located, and a cylinder head 10 is secured to one end of the cylinder 2. In addition, a cylinder head cover 11 is secured to one end of the cylinder head 10, and the cylinder head cover 11, in its interior, has an air-oil separating chamber 15 used as a rocker-arm chamber as well.

A pair of inlet and exhaust valves 14 are fitted into the openings defined in the cylinder head 10 and the other end of each valve 14 extends to be kept in contact with one end of each of rocker arms 18 within an air-oil separating chamber 15; provided, however, that FIG. 2 shows solely the visible one of the valve pair 14 for the sake of simplicity.

Figure 1:
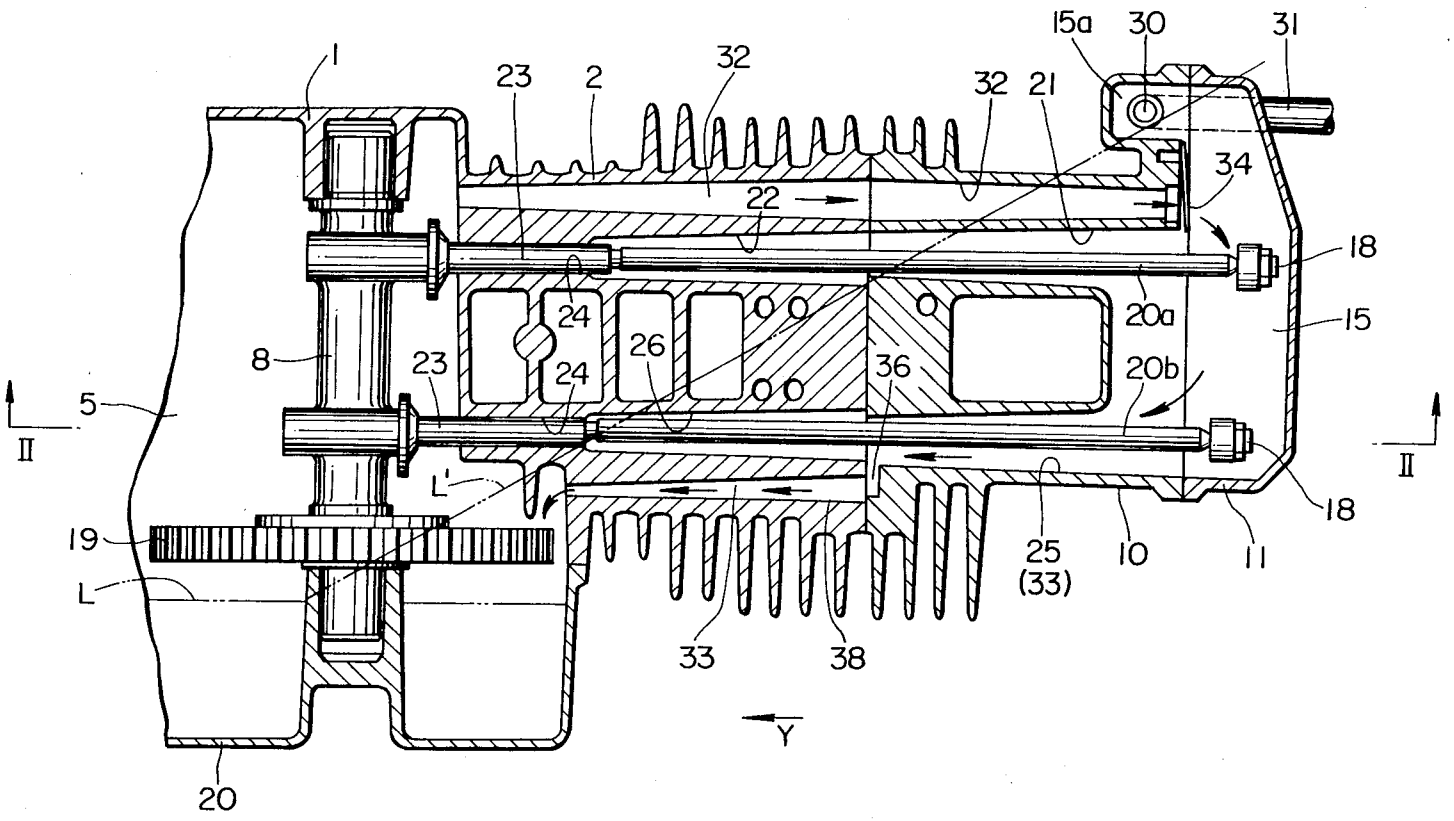
FIG. 1 is a diagrammatic, longitudinal section partially showing a horizontal cylinder overhead valve engine incorporating a preferred embodiment of the lubricating system of this invention.

Referring to FIG. 1 showing a section vertically cut away along the cam shaft 8 (or section taken along the line I—I of FIG. 2), the upper side of the crankcase 1 is closed and a lubricating-oil tank 20 is secured to the lower side of the crankcase 1, a lubricating oil is stored in the oil tank 20 in such a manner as to maintain a constant liquid level L.

The cam shaft 8 for driving the inlet and exhaust valves 14 is kept in engagement with a crank gear (not shown) of the crank shaft 6 (shown in FIG. 2) through a cam gear 19.

As shown in FIG. 1, a pair of the rocker arms 18 are disposed in such a manner that one corresponds to the inlet one of the valve pair 14 and the other corresponds to the exhaust one of the pair 14, and one end of each of the rocker arms 18 is kept in contact with one end of each push rods 20*a*, 20*b* for driving the inlet and exhaust valves 14. The other end of each of the push rods 20*a*, 20*b* is kept in contact with the cam shaft 8 through a valve tappet 23. The push rod 20*a* (on the upper side as viewed in FIG. 2) is so disposed as to extend through a rod-inserting bore 21 of the cylinder head 10 into another rod-inserting bore 22 of the cylinder 2. The push rod 20*b* (on the lower side as viewed in FIG. 2) is so disposed as to extend through a rod-inserting bore 25 of the cylinder head 10 into another rod-inserting bore 26 of the cylinder 2. The respective valve tappets 23 are fitted into tappet-inserting bores 24 of the cylinder 2 for free movement in the horizontal direction, and the ends of the rod-inserting bores 22, 26 near the crank chamber 5 are closed.

As shown in FIG. 1, the air-oil separating chamber 15 (or rocker arm chamber) is so formed as to extend upwardly and to have a portion 15*a*, and the portion 15*a* has a breather port 30. The breather port 30 is connected through a breather pipe 31 to an air cleaner (not shown) and a carburetor (not shown).

The engine having such a construction, as shown in FIG. 1, has a pair of upper and lower passages 32, 33 providing communication between the crank chamber 5 and the air-oil separating chamber 15, and the passage 32 is used as a breather passage 32 and the passage 33 is used as an oil-returning passage 33.

The breather passage 32 extends to be substantially horizontally passed through the cylinder 2 and the cylinder head 10 and above the rod-inserting bores 21, 22 as viewed in FIG. 1. The cylinder 2 and the cylinder head 10 respectively have bores tapared in directions opposite to each other, and the bores are coaxially coupled with each other, forming the breather passage 32 in the form of a single passage. The end of the breather passage 32 adjacent to the air-oil separating chamber 15 has a breather valve 34 of a reed-valve type, and the valve 34 is arranged to open when the pressure within the crank chamber 5 changes from negative to positive as a result of the leftward movement of a piston 35 shown in FIG. 2 and to close when the pressure within the crank chamber 5 changes from positive to negative as a result of the rightward movement of the piston 35.

As shown, an oil passage is formed under the rod-inserting bore 26 of the cylinder 2, and the oil passage and the rod-inserting bore 25 of the cylinder head 10 constitute the oil-returning passage 33 having a stair-like section. An orifice 36 (or resistance means) having a small sectional area is defined at an intermediate portion in the oil-returning passage 33, i.e., at the portion where the cylinder 2 is united with the cylinder head 10, and the orifice 36 is so formed as to extend downwardly towards the crank chamber 5 at a location between the air-oil separating chamber 15 and the crank chamber 5 as viewed in FIG. 1. When oil is present in the orifice 36 and the pressure within the crank chamber 5 changes from negative to positive, the orifice 36 serves as a resistance means which functions to enhance oil circulation resistance against the oil flow in the direction towards the chamber 15 by imparting a pressure gradient to the oil.

Figure 3:
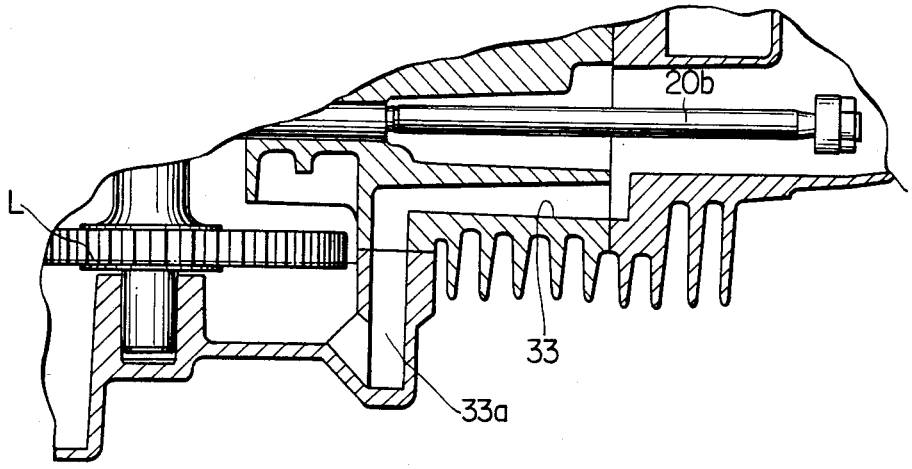
FIGS. 3, 4 and 5 are diagrammatic section, partially broken away, showing in part modifications of the preferred embodiment of the present invention, respectively.

FIG. 3 shows another example of the resistance means for imparting a resistance to the oil-returning passage 33 which constitutes a part of this embodiment of the present invention. Instead of the above-described orifice 36, the end of the oil-returning passage 33 adjacent to the crank chamber 5 is bent downwardly along the vertical wall of the crank chamber 5 and the end 33*a* is opened below the liquid level L. When the pressure within the crank chamber 5 changes from negative to positive, oil is forced upwardly in the vertically-bent portion of the oil-returning passage 33 and forms an oil column, and a pressure difference is thereby generated, so that the flow of oil is prevented.

Figure 4:
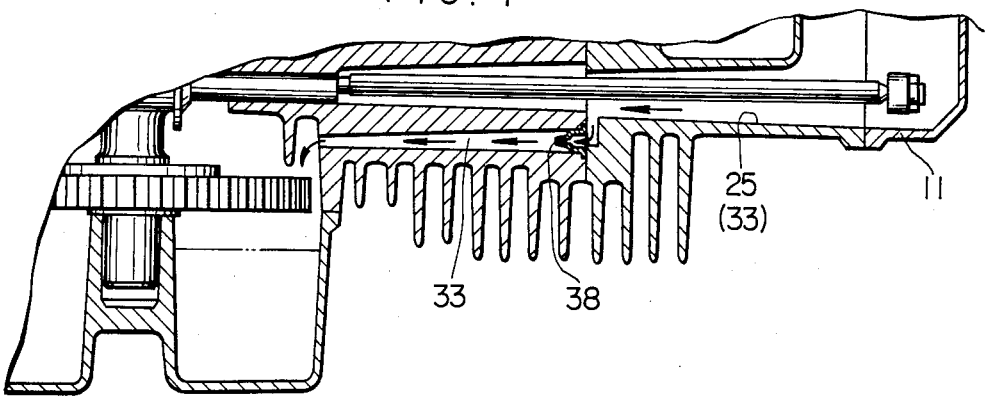
Figure 5:
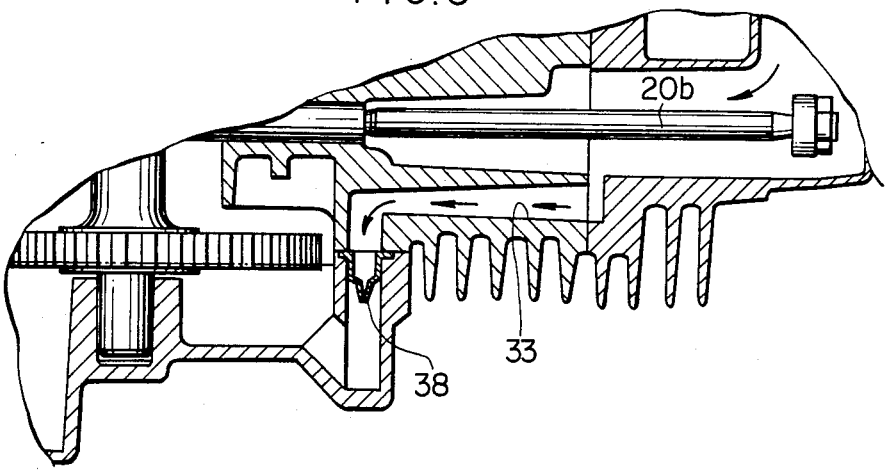

FIGS. 4 and 5 show other examples of the above-described resistance means which is incorporated in this embodiment. As shown in the Figures, a check valve 38 is used to prevent oil from reversing from the crank chamber 5 to the air-oil separating chamber 15. The check valve 38 is arranged to be consistently closed while the engine is inoperative. While the engine is operative, when the piston 35 shown in FIG. 2 moves leftwardly and the pressure within the crank chamber 5 thereby changes from negative to positive, the valve 38 is correspondingly closed. Conversely, when the piston 35 shown in FIG. 2 moves rightwardly and the pressure within the crank chamber 5 thereby changes from positive to negative, the check valve 38 is correspondingly opened.

FIG. 4 shows an example in which the check valve 38 is disposed at the joint portion where the cylinder 2 and the cylinder head 10 are joined together. FIG. 5 shows another example in which the check valve 38 is disposed at the joint portion where the cylinder 2 and the oil tank 20 are joined together, the example being applied to the oil returning passage 33 which is arranged as shown in FIG. 3.

Figure 6:
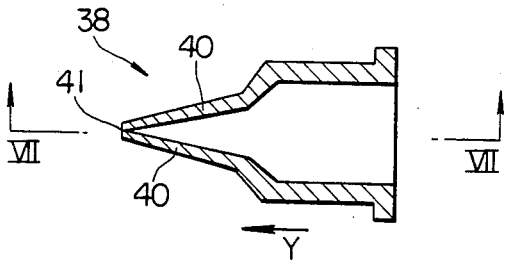
FIG. 6 is an enlarged section of an oil check valve incorporated in the lubricating system of this invention.
Figure 7:
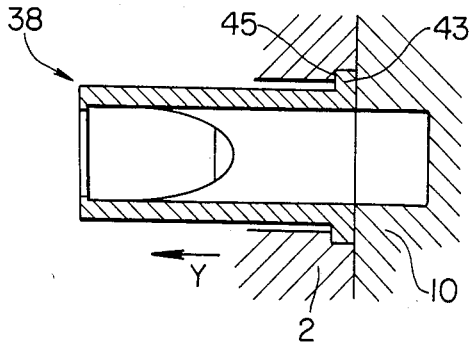
FIG. 7 is a section taken along the line VII—VII of FIG. 6.

The structure of the check valve 38 will be described below in detail with reference to FIGS. 6 and 7.

As shown, the end portion of the check valve 38 facing the crank chamber 5 (or portion placed in the direction indicated by an arrow Y) is formed in the shape of a pair of tongues 40. A slit 41 is formed at the end of the tongue pair 40 in such a manner as to be capable of freely opening and closing. The slit 41 is consistently closed while the engine is inoperative. In addition, as shown in FIG. 7, a flange portion 43 is formed at the other end of the check valve 38, i.e., the portion which is defined in the portion opposite to the direction indicated by the arrow Y. In the example shown in FIG. 4, the flange portion 43 is fitted into an annular recess 45 formed in the end surface of the cylinder 2 adjacent to the cylinder head 10, and is pressed against the recess 45 by the end surface of the cylinder head 10 facing the cylinder 2. In the example shown in FIG. 5, the check valve 38 having the same structure as that illustrated in FIG. 4 is vertically mounted, and is fixed in substantially the same manner as shown in FIG. 4.

Figure 8:
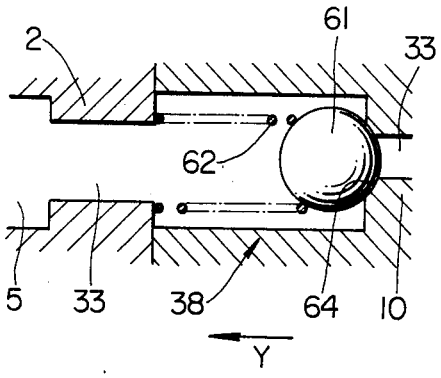
FIG. 8 is a section of another example of the oil check valve.

FIG. 8 shows another example of the oil check valve 38 incorporated in this embodiment of the present invention, in which a ball member 61 and a coil spring 62 are used. Specifically, a valve seat 64 is formed at a location in the oil-returning passage 33, and the spring 62 is arranged to urge the ball member 61 in the direction opposite to that indicated by the arrow Y, thereby keeping the ball member 61 in contact with the valve seat 64.

While the engine is inoperative, the ball member 61, as shown in FIG. 8, is kept in contact with the valve seat 64, and, in this state the ball member 61 prevents oil from flowing back from the crank chamber 5 to the air-oil separating chamber 15.

While the engine is operative, when the pressure within the crank chamber 5 changes from positive to negative, the ball member 61 is caused to move leftwardly (as viewed in FIG. 8) against the force of the spring 62 due to the negative pressure.

As a matter of course, in addition to the above-described examples, various check valves having one-way function such as a reed valve may be used.

The operation of the lubricating system of this invention will be described below with specific reference to FIGS. 1 and 2.

While the engine is inoperative, the breather valve 34 is closed and the check valve 38 is also closed if it is used.

When the engine is operative, while the piston 35 shown in FIG. 2 is moving leftwardly, the pressure within the crank chamber 5 changes from negative to positive, and the breather valve 34 shown in FIG. 1 is opened. Meanwhile, since the resistance acting on the oil-returning passage 33 is high, the oil mist within the crank chamber 5 enters the air-oil separating chamber 15 mainly through the breather passage 32 and the breather valve 34. The oil mist thus introduced into the chamber 15 strikes various structures contained therein, and is thereby separated into the oil component and the air component. The separated air reaches the horizontally bent portion 15*a* formed in the upper portion of the chamber 15, and is then fed into the breather pipe 31 through the portion 15*a* and the breather port 30. The air is in turn supplied to the carburetor (not shown) through the air cleaner (not shown). On the other hand, the separated oil lubricates the rocker arms 18 and a mechanism for operating valves such as the intake and exhaust valves 14, and is collected at the bottom of the air-oil separating chamber 15.

While the piston 35 shown in FIG. 2 is moving rightwardly, the pressure within the crank chamber 5 shown in FIG. 1 changes from positive to negative, the breather valve 34 is closed. In consequence, once the lubricating oil has completed lubrication, it is returned to the interior of the crank chamber 5 through the oil-returning passage 33, the orifice 36 and the check valve 38 due to the negative pressure generated within the crank chamber 5.

In this manner, the oil mist and the oil flow in the breather passage 32 and the oil-returning passage 33 substantially in one direction only, respectively. The oil mist is efficiently delivered to the air-oil separating chamber 15 due to the pulsation of the pressure within the crank chamber 5 caused by the reciprocal movement of the piston 35 shown in FIG. 2. The thus-supplied oil lubricates the valve operating mechanism disposed within the chamber 15 and is collected in the bottom of the chamber 15. The collected oil is immediately supplied to the crank chamber 5. Further, even if the engine is inclined in such a manner that the liquid level L within the oil tank 20 reaches the position indicated by a chain line L', the oil is always protected from flowing back toward the air-oil separating chamber 15, by means of the orifice or the check valve.

When provided with a check valve, unfavorable oil back-flow can be prevented even in rather stationary, adverse conditions such as follows.

Figure 9:
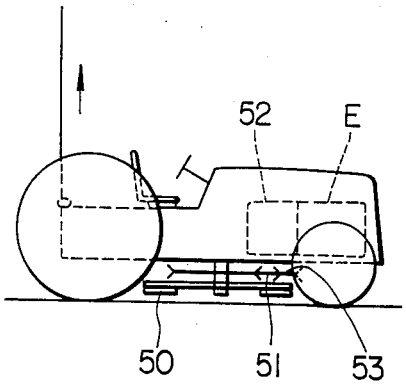
FIG. 9 is a diagrammatic side elevational view of a tractor for a lawn mower having an engine incorporating the lubricating system of this invention, showing the engine in the interior which are not normally visible from the exterior.

FIG. 9 shows an example of using an engine E incorporating the above-described system. As shown, a tractor for a lawn mower has the horizontal cylinder engine E, and the transmission casing 52 supports a power take off shaft 53 in such a manner that the shaft 53 faces the earth. A lawn mower 50 is rotatably mounted in the center of the underside of the tractor, and is interlockingly coupled with the power take off shaft 53 through a belt transmission mechanism 51. While the engine is inoperative, for example, when an operator is to replace the cutter of the mower 50 or the belt of the belt transmission mechanism 51, or when he/she is to inspect the underside of the engine E, the rear portion of the tractor is lifted upwardly by using such means such as a crane. In this state, the cylinder head of the engine E is greatly inclined downwardly. In this case, the lubricating oil within the oil tank 20 tends to flow from the crank chamber 5 to the air-oil separating chamber 15 through the oil-returning passage 33. However, the oil check valve 38 disposed at a location in the passage 33 prevents the oil from flowing in the reverse direction.

In the above-described embodiment, the lubricating system of this invention is applied to the engine in which the cylinders are horizontally disposed in a normal state. However, it is a matter of course that this invention can be adapted for an engine of the type in which the cylinders are normally used in such a manner that the cylinder heads are inclined upwardly, but, during the inspection of the engine, the cylinder heads are tilted downwardly.

Furthermore, this invention may be applied to an engine of the type which is arranged to discharge exhaust gases directly out of the engine, without the breather port being connected to the air cleaner, the carburetor or the like.

In the above-described embodiment, the rocker-arm chamber is used as the air-oil separating chamber 15 as well. However, this arrangement is only illustrative, and the present invention can be applied to an engine of the type in which the air-oil separating chamber 15 is disposed adjacent to the cylinder head 10 and is separated from the rocker-arm chamber.

It should be noted that, while the above-described embodiment adopts a vertical shaft type engine, a horizontal shaft type engine can also be used.

In addition, although the breather passage 32 and the oil-returning passage 33 are integral with the cylinder 2 and the cylinder head 10, this arrangement is not exclusive. Both or either of the passages 32, 33 may be formed by using a separate pipe member.

In the description of the preferred embodiment of this invention, reference is made to the system in which the intake and exhaust valves 14 are actuated through the rocker arms 18. However, this invention is not limited to this arrangement and can be applied to such a system as may include other valve actuating means.

Finally, the foregoing embodiment adopts the check valve 38 of a reed valve type. As a matter of course, another type of valve can be used, and the valve may be disposed at a desired position in the breather passage 32.

Having described a specific embodiment of our lubricating system, it is believed obvious that modification and variation of our invention is possible in light of the above teachings.

What is claimed is:

1. A lubricating system for an internal combustion engine having:

a cylinder with a substantially horizontal axis and a valve at the head thereof;

a crank chamber for accumulating lubricating oil;

an air-oil separating chamber for accomodating a part of a mechanism for operating said valve;

a breather passage connecting said crank chamber and said air-oil separating chamber for supplying oil mist to said valve operating mechanism; and a lubricating-oil returning passage which is disposed under said breather passage such as to connect said crank chamber and said air-oil separating chamber and through which said lubricating oil accumulated in said air-oil separating chamber flows toward said crank chamber, said system comprising means disposed in said breather passage in such a manner as to allow a fluid to flow solely toward said air-oil separating chamber and means disposed in said lubricating-oil returning passage in such a manner as to impart to the flow of said fluid toward said air-oil separating chamber a resistance higher than that of said fluid flow toward said air-oil separating chamber through said breather passage.

2. A lubricating system for an internal combustion engine according to claim 1, wherein said means for imparting said resistance is an orifice having a small sectional area and extending downwardly toward said crank chamber.

3. A lubricating system for an internal combustion engine according to claim 1, wherein said means for imparting said resistance is a lubricating oil column.

4. A lubricating system for an internal combustion engine according to claim 1, wherein said means for imparting said resistance is a check valve allowing a fluid to flow solely toward said crank chamber.

* * * * *

REEXAMINATION CERTIFICATE (1570th)

United States Patent [19]

Mitadera et al.

[11] B1 4,688,529

[45] Certificate Issued Oct. 15, 1991

[54] LUBRICATING SYSTEM FOR HORIZONTAL CYLINDER OVERHEAD VALVE ENGINE

[75] Inventors: Takashi Mitadera, Akashi; Tetsuaki Shirai, Kobe; Tomozo Nakagawa; Naotake Nii, both of Akashi; Kozo Watanabe, Ono, all of Japan

[73] Assignee: Kawasaki Jukogyo Kabushiki Kaisha, Kobe, Japan

Reexamination Request:
No. 90/002,240, Dec. 26, 1990

Reexamination Certificate for:

| | |
|---|---|
| Patent No.: | **4,688,529** |
| Issued: | **Aug. 25, 1987** |
| Appl. No.: | **883,718** |
| Filed: | **Jul. 9, 1986** |

[30] Foreign Application Priority Data

| | | | |
|---|---|---|---|
| Jul. 10, 1985 | [JP] | Japan | 60-152812 |
| Feb. 20, 1986 | [JP] | Japan | 61-36033 |

[51] Int. Cl.[5] ..... F01M 1/00

[52] U.S. Cl. ..... 123/196 R; 123/195 HC; 184/6.5; 184/6.9

[58] Field of Search ..... 123/196 R, 195 HC, 90.33; 184/6.5, 6.9, 6.6

[56] References Cited

U.S. PATENT DOCUMENTS

| | | | |
|---|---|---|---|
| 2,781,632 | 2/1957 | Meijer | 60/24 |
| 3,456,759 | 7/1969 | Henry-Blabaud | 184/6 |
| 4,470,389 | 9/1984 | Mitadera et al. | 123/196 |
| 4,570,587 | 2/1986 | Watanabe et al. | 123/195 C |

FOREIGN PATENT DOCUMENTS 60-6585 3/1985 Japan .

*Primary Examiner*—E. Rollins-Cross

[57] ABSTRACT

A lubricating system for an internal combustion engine is disclosed. This system includes a pair of passages formed between a crank chamber for reserving oil and an air-oil separating chamber accommodating a mechanism for actuating overhead valves. The pair of passages are constituted by a breather passage formed in the upper portion of a cylinder and the oil-returning passage formed in the lower portion of the cylinder. The breather passage has a valve for allowing a fluid to pass solely toward the air-oil separating chamber and a large oil-circulating resistance is imparted to the fluid flowing toward the air-oil separating chamber through the oil-returning passage, thereby circulating an oil mist in one direction only by using the reciprocal motion of each piston. Even when the engine is inclined, oil is prevented from flowing back from the crank chamber to the separating chamber through the oil-returning passage.

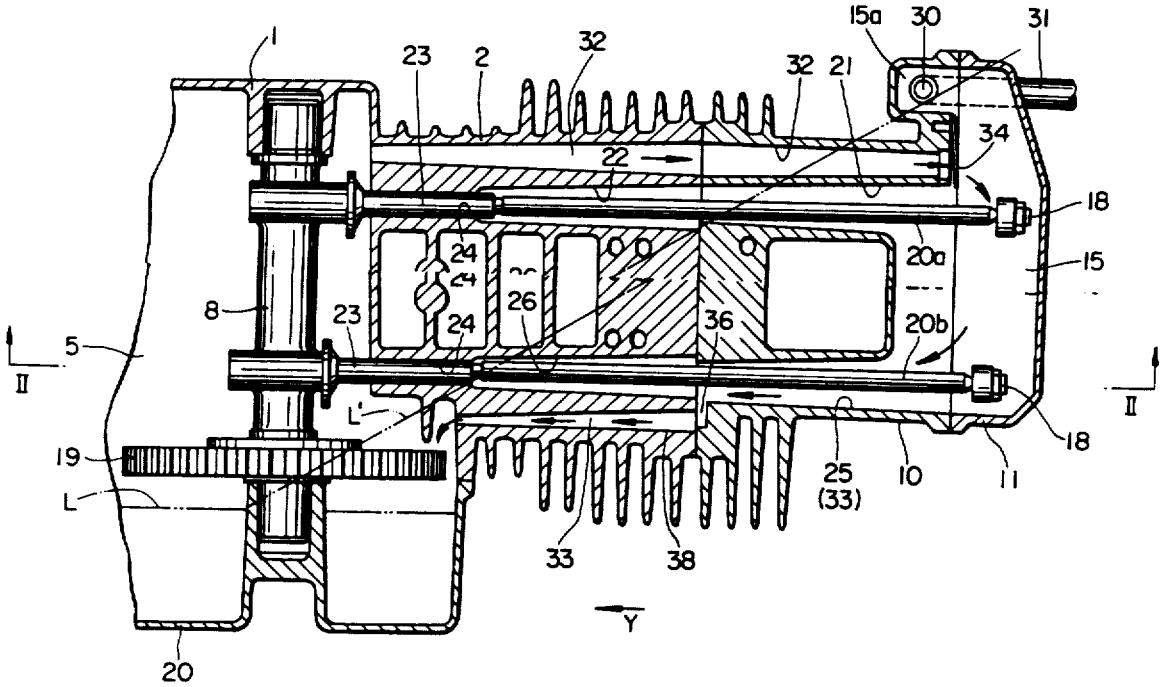

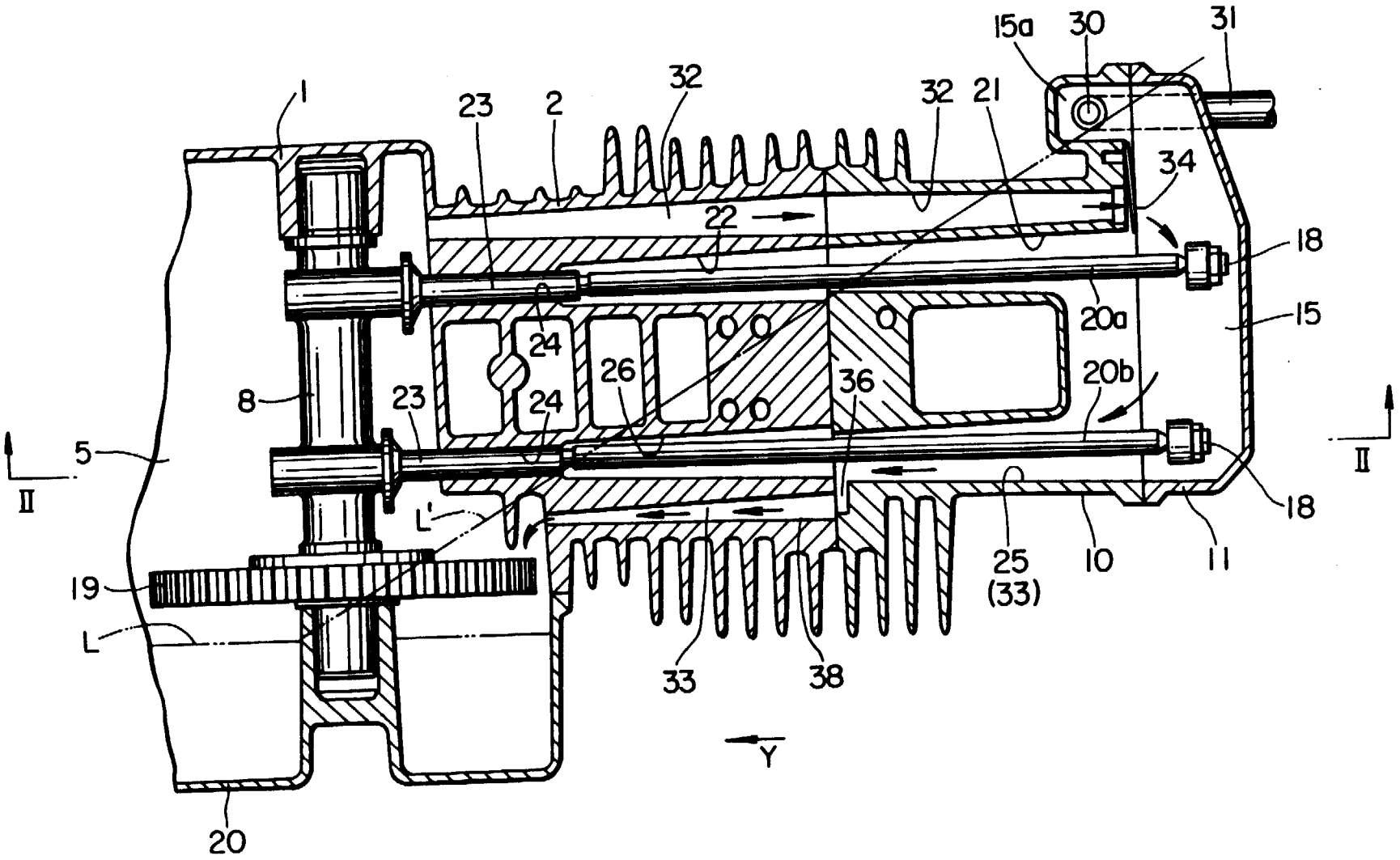
II
18
15
18
31
11
34
20a
20b
10
30
15a
21
25
(33)
32
36
38
22
Y
32
33
26
2
24
24
23
L'
23
1
8
20
5
19
L
II

REEXAMINATION CERTIFICATE ISSUED UNDER 35 U.S.C. 307

THE PATENT IS HEREBY AMENDED AS INCIDATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 7–19:

The present invention generally relates to an internal combustion engine in which the cylinder or cylinders is disposed substantially horizontally, the cylinder having intake and exhaust valves [at] *in* its head. More specifically, this invention pertains to a lubricating system incorporated in the foregoing internal combustion engine which is equipped with a breather passage and an oil-returning passage providing communication between a crank chamber for storing a lubricating oil and an air-oil separating chamber located on the side of the cylinder head, without any special lubricating pump being included for lubricating a valve drive mechanism.

Column 3, lines 22–42:

As shown in FIG. 1, a pair of the rocker arms 18 are disposed in such a manner that one corresponds to the inlet one of the valve pair 14 and the other corresponds to the exhaust one of the pair 14, and one end of each of the rocker arms 18 is kept in contact with one end of each push rods 20a, 20b for driving the inlet and exhaust valves 14. The other end of each of the push rods 20a, 20b is kept in contact with the cam shaft 8 through a valve tappet 23. The push rod 20a (on the upper side as viewed in FIG. [2] *1*) is so disposed as to extend through a rod-inserting bore 21 of the cylinder head 10 into another rod-inserting bore 22 of the cylinder 2. The push rod 20b (on the lower side as viewed in FIG. [2] *1*) is so disposed as to extend through a rod-inserting bore 25 of the cylinder head 10 into another rod-inserting bore 26 of the cylinder 2. The respective valve tappets 23 are fitted into tappet-inserting bores 24 of the cylinder 2 for free movement in the horizontal direction, and the ends of the rod-inserting bores 22, 26 near the crank chamber 5 are closed.

Column 7, lines 9–12:

Finally, the foregoing embodiment adopts the check valve [38] *34* of a reed valve type. As a matter of course, another type of valve can be used, and the valve may be disposed at a desired position in the breather passage 32.

AS A RESULT OF REEXAMINATION, IT HAS BEEN DETERMINED THAT:

Claim 1 is determined to be patentable as amended.

Claims 2, 3 and 4, dependent on an amended claim, are determined to be patentable.

New claims 5, 6, 7, 8, 9 and 10 are added and determined to be patentable.

1. A lubricating system for an internal combustion engine having:

a cylinder with a substantially horizontal axis and a valve [at] *in* the head thereof;

a crank chamber for accumulating lubricating oil;

an air-oil separating chamber for accomodating a part of a mechanism for operating said valve;

a breather passage *directly* connecting said crank chamber and said air-oil separating chamber for supplying oil mist to said valve operating mechanism; and a lubricating-oil returning passage which is disposed under said breather passage such as to connect said crank chamber and said air-oil separating chamber and through which said lubricating oil accumulated in said air-oil separating chamber flows toward said crank chamber, said system comprising means disposed in said breather passage in such a manner as to allow a fluid to flow solely toward said air-oil separating chamber and means disposed in said lubricating-oil returning passage in such a manner as to impart to the flow of said fluid toward said air-oil separating chamber a resistance higher than that of said fluid flow toward said air-oil separating chamber through said breather passage.

*5. A lubricating system for an internal combustion engine according to claim 1 wherein said breather passage is superposed above and coextensive with said lubricating-oil returning passage.*

*6. A lubricating system for an internal combustion engine according to claim 1 wherein said breather passage is arranged parallel to said lubricating-oil returning passage.*

*7. A lubricating system for an internal combustion engine according to claim 1 wherein said means disposed in said breather passage in such a manner as to allow a fluid to flow solely toward said air-oil separating chamber comprises a breather valve located in a wall separating said breather passage from said air-oil separating chamber.*

*8. A lubricating system for an internal combustion engine according to claim 2 wherein said orifice comprises a section of said lubricating-oil returning passage arranged substantially perpendicular to the axis of the longest portion of said lubricating-oil returning passage.*

*9. A lubricating system for an internal combustion engine according to claim 8 wherein said section of said lubricating-oil returning passage is arranged substantially vertically.*

*10. A lubricating system for an internal combustion engine according to claim 1 wherein said breather passage is substantially horizontal.*

* * * * *